US011118287B2

(12) United States Patent
Shimada et al.

(10) Patent No.: US 11,118,287 B2
(45) Date of Patent: Sep. 14, 2021

(54) FABRIC AND PROTECTIVE PRODUCT

(71) Applicant: TEIJIN LIMITED, Osaka (JP)

(72) Inventors: Hiroki Shimada, Osaka (JP); Kenji Iwashita, Osaka (JP)

(73) Assignee: TEIJIN LIMITED, Osaka (JP)

( * ) Notice: Subject to any disclaimer, the term of this patent is extended or adjusted under 35 U.S.C. 154(b) by 111 days.

(21) Appl. No.: 15/779,614

(22) PCT Filed: Nov. 11, 2016

(86) PCT No.: PCT/JP2016/083562
§ 371 (c)(1),
(2) Date: May 29, 2018

(87) PCT Pub. No.: WO2017/094477
PCT Pub. Date: Jun. 8, 2017

(65) Prior Publication Data

US 2018/0347079 A1 Dec. 6, 2018

(30) Foreign Application Priority Data

Dec. 2, 2015 (JP) ..... JP2015-235742

(51) Int. Cl.

| | |
|---|---|
| ***D03D 15/513*** | (2021.01) |
| ***A41D 13/008*** | (2006.01) |
| ***D02G 3/04*** | (2006.01) |
| ***D02G 3/44*** | (2006.01) |
| ***A41D 19/00*** | (2006.01) |
| ***A41D 19/015*** | (2006.01) |

(52) U.S. Cl.
CPC ..... *D03D 15/513* (2021.01); *A41D 13/008* (2013.01); *A41D 19/00* (2013.01); *A41D 19/015* (2013.01); *A41D 19/01529* (2013.01); *D02G 3/047* (2013.01); *D02G 3/443* (2013.01); *D10B 2201/00* (2013.01); *D10B 2331/021* (2013.01); *D10B 2331/04* (2013.01); *D10B 2501/041* (2013.01)

(58) Field of Classification Search
CPC .... A41D 13/008; A41D 19/00; A41D 19/015; A41D 19/01529; D02G 3/047; D02G 3/443; D10B 2201/00; D10B 2331/021; D10B 2331/04; D10B 2501/041
See application file for complete search history.

(56) References Cited

U.S. PATENT DOCUMENTS

| | | | |
|---|---|---|---|
| 3,953,167 | A | 4/1976 | Minemura et al. |
| 5,356,700 | A | 10/1994 | Tanaka et al. |
| 6,132,476 | A | 10/2000 | Lunsford et al. |
| 2005/0025962 | A1 | 2/2005 | Zhu et al. |
| 2005/0032449 | A1 | 2/2005 | Lovasic et al. |
| 2010/0009186 | A1 | 1/2010 | Zhu |
| 2012/0286177 | A1 | 11/2012 | Cliver et al. |
| 2014/0020190 | A1 | 1/2014 | Oiwa et al. |

FOREIGN PATENT DOCUMENTS

| | | | |
|---|---|---|---|
| CN | 103459710 | A | 12/2013 |
| EP | 2692942 | A1 | 2/2014 |
| JP | 52-22739 | A | 2/1977 |
| JP | 61-138780 | A | 6/1986 |
| JP | 04-050340 | A | 2/1992 |
| JP | 10-102384 | A | 4/1998 |
| JP | 2001-104500 | A | 4/2001 |
| JP | 2006-516306 | A | 6/2006 |
| JP | 2007-501341 | A | 1/2007 |
| JP | 2007-023451 | A | 2/2007 |
| JP | 2007-217801 | A | 8/2007 |
| JP | 2007-529648 | A | 10/2007 |
| JP | 2007-535415 | A | 12/2007 |
| JP | 2009-503278 | A | 1/2009 |
| JP | 2009-057652 | A | 3/2009 |
| JP | 2009-120976 | A | 6/2009 |
| JP | 2010-502849 | A | 1/2010 |
| JP | 2011-149122 | A | 8/2011 |
| JP | 2011-527734 | A | 11/2011 |
| JP | 4846739 | B2 | 12/2011 |
| JP | 2013-133567 | A | 7/2013 |
| JP | 2014-210984 | A | 11/2014 |
| JP | 2014-210985 | A | 11/2014 |
| WO | 2010/141554 | A1 | 12/2010 |
| WO | 2011/126999 | A1 | 10/2011 |
| WO | 2012/077681 | A1 | 6/2012 |

OTHER PUBLICATIONS https://patents.google.com/patent/JP2014210985A/en?oq=JP+2014-210985 (Year: 2013).*
https://patents.google.com/patent/JP2011149122A/en?oq=CN201680070766 (Year: 2010).*
https://patents.google.com/patent/CN 103459710B/en?oq=103459710 (Year: 2012).*
International Search Report of PCT/JP2016/083562 dated Feb. 14, 2017.
Communication dated Jun. 18, 2019, from the Japanese Patent Office in counterpart application No. 2017-553742.
Tetsuya Kato, "Basic Knowledge of Industrial Fiber", The Nikkan Kogyo Shimbun, Ltd., Jan. 28, 2011, pp. 108-109, pp. 120-121, 6 pages total.
Industrial Fiber Materials Handbook, The Textile Machinery Society Japan, Jun. 25, 1979, pp. 148-149, 3 pages total.
Color Science Handbook (Third edition), The Color Science Association of Japan, Apr. 20, 2011, pp. 1246-1247, pp. 1258-1259, 7 pages total.
Communication dated Dec. 6, 2018, from European Patent Office in counterpart application No. 16870416.1.
Communication dated Jun. 19, 2019 issued by the China National Intellectual Property Administration in counterpart application No. 201680070766.4.

(Continued)

*Primary Examiner* — Arti Singh-Pandey
(74) *Attorney, Agent, or Firm* — Sughrue Mion, PLLC

(57) ABSTRACT

The invention addresses the problem of providing a cloth and a protective product that have lightweight properties, wearing comfort, and further protection performance against electric arcs. A means for resolution is a cloth including a spun yarn containing a meta-type wholly aromatic polyamide fiber, wherein the cloth has a lightness index L-value of 25 or less.

9 Claims, No Drawings

(56) References Cited

OTHER PUBLICATIONS

Communication dated Nov. 11, 2019 from the State Intellectual Property Office of the P.R.C. in CN Application No. 201680070766.4.
Communication dated Dec. 24, 2019 from Japanese Patent Office in JP Application No. 2017-553742.
Communication dated Jun. 30, 2020 from Japanese Patent Office in JP Application No. 2017-553742.

* cited by examiner

FABRIC AND PROTECTIVE PRODUCT

CROSS REFERENCE TO RELATED APPLICATIONS

This application is a National Stage of International Application No. PCT/JP2016/083562 filed Nov. 11, 2016, claiming priority based on Japanese Patent Application No. 2015-235742 filed Dec. 2, 2015.

The present invention relates to a cloth and a protective product that have lightweight properties, wearing comfort, and further protection performance against electric arcs.

BACKGROUND ART

Those who work near electrical equipment and ambulance officers who deal with accidents near electrical equipment may be subconsciously exposed to electric arcs or flash fires. An electric arc is an extremely cataclysmic phenomenon usually accompanied by an electricity of thousands of volts and thousands of amperes. The phenomenon is caused in, the air in the case where a potential difference between two electrodes (i.e., voltage) ionizes atoms in the air, thereby enabling electricity to be conducted.

For protection from such electric arcs and flash fires, cloths using various flame-retardant fibers have been proposed (see, e.g., PTLs 1 to 11).

However, cloths that have lightweight properties, wearing comfort, and also protection performance against electric arcs have not been much proposed so far.

CITATION LIST

Patent Literature

PTL 1: WO2011/126999
PTL 2: WO2010/141554
PTL 3: JP-T-2011-527734
PTL 4: JP-T-2009-503278
PTL 5: JP-T-2007-529648
PTL 6: JP-T-2007-535415
PTL 7: JP-T-2007-501341
PTL 8: JP-T-2006-516306
PTL 9: JP-T-2010-502849
PTL 10: Japanese Patent No. 04846739
PTL 11: WO2012/077681

SUMMARY OF INVENTION

Technical Problem

The invention has been accomplished in light of the above background. An object thereof is to provide a cloth and a protective product that have lightweight properties, wearing comfort, and further protection performance against electric arcs.

Solution to Problem

The present inventors have conducted extensive research to solve the above problems. As a result, they have found that when a cloth including a spun yarn containing a meta-type wholly aromatic polyamide fiber has a deep color, such a cloth has improved protection performance against electric arcs. As a result of further extensive research, they have accomplished the invention.

Thus, the invention provides "a cloth including a spun yarn containing a meta-type wholly aromatic polyamide fiber and having a lightness index L-value of 25 or less."

At this time, it is preferable that the meta-type wholly aromatic polyamide fiber contains an infrared-absorbing inorganic substance. It is preferable that, the infrared-absorbing inorganic substance is carbon black. In addition, it is preferable that the spun yarn contains the meta-type wholly aromatic polyamide fiber in an amount of 25% by weight or more with respect to the weight of the spun yarn. In addition, it is preferable that the spun yarn further contains a cellulosic fiber in an amount of 10 to 40% by weight with respect to the weight of the spun yarn. In addition, it is preferable that the spun yarn further contains a molten fiber in an amount of 5 to 20% by weight with respect to the weight of the spun yarn. It is preferable that the molten fiber is at least one member selected from the group consisting of vinylon fibers, nylon fibers, and polyester fibers. In addition, it is preferable that the single-fiber cross-sectional shape of the molten fiber is a round shape, modified shape, or hollow shape. In addition, it is preferable that the spun yarn further contains at least one member selected from the group consisting of para-type wholly aromatic polyamide fibers, polyphenylene sulfide fibers, polyimide fibers, polybenzimidazole fibers, polybenzoxazole fibers, polyamideimide fibers, polyetherimide fibers, Pyromex®, carbon fibers, and conductive fibers in an amount of 3 to 20% by weight with respect to the weight of the spun yarn.

In the cloth of the invention, it is preferable that the cloth has a woven fabric structure. In addition, it is preferable that the cloth has a thickness of 0.25 to 0.50 mm. In addition, it is preferable that the cloth has a basis weight within a range of 3.0 to 9.0 oz/yd$^2$. In addition, it is preferable that the cloth has an ATPV value of 8 cal/cm$^2$ or more in Arc Resistance Test ASTM F1959-1999. In addition, it is preferable that the cloth has a limiting oxygen index LOI of 26 or more.

The invention also provides a protective product using the cloth described above and selected from the group consisting of protective garments, fireproof garments, work garments, activity garments, gloves, and members for protection.

Advantageous Effects of Invention

According to the invention, a cloth and a protective product that have lightweight properties, wearing comfort, and further protection performance against electric arcs are obtained.

DESCRIPTION OF EMBODIMENTS

Hereinafter, embodiments of the invention will be described in detail. The cloth of the invention is a cloth including a spun yarn containing a meta-type aromatic polyamide fiber. The cloth has a lightness index L-value of 25 or less (preferably 10 to 25).

Here, it is preferable that the meta-type wholly aromatic polyamide fiber contains an infrared-absorbing inorganic substance whose absorption rate of light at 1,000 to 1,500 nm is 70% or more. As such infrared-absorbing inorganic fine particles, carbon black is preferable, but deep-color pigments are also applicable.

In terms of durability, the infrared-absorbing inorganic substance is preferably contained in the polymer forming the meta-type wholly aromatic polyamide fiber, but may also adhere to the fiber surface.

At this time, it is preferable that the content of the infrared-absorbing inorganic substance is 1% by weight or more (more preferably 2 to 9% by weight) with respect to the weight of the fiber. When the content is less than 1% by weight, the lightness index L-value is not reduced, and the protection performance against electric arcs may decrease.

The polymer forming the meta-type wholly aromatic polyamide fiber is one in which the aromatic rings that constitute the main backbone are bonded in the meta-position through an amide bond, and 85 mol % or more of all the repeating units of the polymer is a metaphenylene isophthalamide unit. In particular, a polymetaphenylene isophthalamide homopolymer is preferable. As copolymerizable third components accounting for 15 mol % or less, preferably 5 mol % or less, of all the repeating units, as diamine components, for example, aromatic diamines such as paraphenylenediamine, 3,4'-diaminodiphenyl ether, 4,4'-diaminodiphenyl ether, paraxylylenediamine, biphenylenediamine, 3,3'-dichlorobenzidine, 3,3'-dimethylbenzidine, 3,4'-diaminodiphenylmethane, 4,4'-diaminodiphenylmethane, and 1,5-naphthalenediamine can be mentioned. As acid components, for example, aromatic dicarboxylic acids such as terephthalic acid, naphthalene-2,6-dicarboxylic acid, and naphthalene-2,7-dicarboxylic acid can be mentioned. In addition, in these aromatic diamines and aromatic dicarboxylic acids, the hydrogen atoms on the aromatic ring may be partially substituted with a halogen atom or an alkyl group such as a methyl group. In the case where 20% or more of all the polymer ends are blocked with a monovalent diamine, such as aniline, or a monovalent carboxylic acid component, the strength of the fiber does not decrease much even when maintained at a particularly high temperature for a long period of time; therefore, this is preferable. In order to maintain the functional characteristics, the meta-type wholly aromatic polyamide fiber may also contain a flame retardant, a UV absorber, and other functional agents.

In addition, in the meta-type wholly aromatic polyamide fiber, the less the residual solvent, the higher the self-extinguishability of the fiber itself, which is more preferable. It is preferable that the residual solvent content is 1% by weight or less (more preferably 0.3% by weight or less) with respect to the weight of the fiber.

It is preferable that the spun yarn contains the meta-type wholly aromatic polyamide fiber in an amount of 25% by weight or more (more preferably 25 to 75% by weight) with respect to the weight of the spun yarn. When the weight proportion of the meta-type wholly aromatic polyamide fiber is less than 25% by weight, the protection performance against electric arcs may decrease.

In addition, in the case where the spun yarn further contains a cellulosic fiber, upon exposure to an electric arc, the cloth is carbonized to improve the heat conductivity, whereby the energy of the electric arc can be diffused and reduced; therefore, this is preferable. It is particularly preferable that the spun yarn contains a cellulosic fiber in an amount of 10 to 40% by weight with respect to the weight of the spun yarn. When the content of the cellulosic fiber is higher than this range, the tensile strength or tear strength of the cloth may decrease, or the cloth may break up when burned and carbonized, whereby the cloth shape cannot be retained, and a hole is created in the carbonized portion; as a result, the skin of the wearer (worker) may be directly exposed to an external factor. Conversely, when the content of the cellulosic fiber is lower than the above range, the effect that the cloth is carbonized when exposed to an electric arc may not be obtained.

In addition, in the case where the spun yarn contains a molten fiber such as a vinylon fiber, a nylon fiber, or a polyester fiber, the lightweight properties and wearing comfort are improved while keeping the carbonization phenomenon characteristics as a cloth; therefore, this is preferable. In addition, as a phenomenon upon contact with a heat source such as fire, molten fibers have properties of melting and then resinifying. Blending of such a fiber in an appropriate range consequently contributes to the performance to further enhance the fire resistance performance, and thus is preferable. In particular, it is preferable that the spun yarn contains the molten fiber in an amount of 5 to 20% by weight with respect to the weight of the spun yarn. When the content of the molten fiber is higher than this range, the flame retardancy of the cloth may decrease. Conversely, when the content of the molten fiber is lower than this range, lightweight properties and wearing comfort may not be obtained.

Here, it is preferable that the single-fiber cross-sectional shape of the molten fiber is a round shape, modified shape, or hollow shape.

In addition, the polyester fiber is a fiber containing a polyester as one component. The polyester is a polyester in which the main dicarboxylic acid component is terephthalic acid and the main glycol component is at least one glycol, preferably at least one alkylene glycol selected from ethylene glycol, trimethylene glycol, tetramethylene glycol, and the like. As necessary, the polyester may be modified with a third component by copolymerization and/or blending. The polyester may also be a polyester obtained by material recycling or chemical recycling or polyethylene terephthalate obtained using a monomer component produced from a biomass raw material, i.e., a substance of biological origin. Further, it is also possible to use a polyester obtained using a catalyst containing a specific phosphorus compound or titanium compound as described in JP-A-2004-270097 or JP-A-2004-211268.

Incidentally, as necessary, the polyester may contain arbitrary additives such as catalysts, coloring inhibitors, heat stabilizers, flame retardants, antioxidants, and inorganic fine particles. In particular, in the case where a flame retardant is applied in the polyester polymer or to the polyester fiber surface, the flame retardancy of the cloth is improved; therefore, this is preferable.

In the polyester fiber, in terms of increasing the surface area of the fiber to obtain excellent sweat absorbency and the like, it is preferable that the single-fiber fineness is 5.0 dtex or less (more preferably 0.0001 to 1.5 dtex).

In the polyester fiber, it is preferable that the sectional shape (cross-sectional shape) of the single-fiber is a modified shape (shape other than a round shape). As such a modified sectional shape, it is preferable that the section is flat, W-shaped, cross-shaped, hollow (e.g., circular hollow, triangular hollow, square hollow, etc.), or triangular. Further, a flat section having a constricted part as described in JP-A-2004-52191 and a section having a fin part radiantly projecting from the hollow core part as described in JP-A-2012-97380 are also applicable. When an organic fiber has a modified sectional shape, avoid space is created between fibers to cause a capillarity phenomenon, whereby excellent water absorbency is obtained. In addition, there also is a synergistic effect that the moisture absorbed due to the water-absorbing action further improves the flame retardancy. Among the above sectional shapes, a W-shaped section is particularly preferable in that even when the amount of fibers is small, a void space is likely to be created between fibers.

The polyester fiber may be a composite fiber made of two components put together in a side-by-side or eccentric sheath-core manner. Such a composite fiber is usually crimped due to the development of latent crimp, and thus is stretchable and preferable. At this time, it is preferable that the two components forming the composite fiber are a combination selected from the group consisting of a combination of polytrimethylene terephthalate and polytrimethylene terephthalate, a combination of polytrimethylene terephthalate and polyethylene terephthalate, and a combination of polyethylene terephthalate and polyethylene terephthalate.

In addition, in the case where the spun yarn further contains at least one member selected from the group consisting of para-type wholly aromatic polyamide fibers, polyphenylene sulfide (PPS) fibers, polyimide fibers, polybenzimidazole (PBI) fibers, polybenzoxazole (PBO) fibers, polyamideimide fibers, polyetherimide fibers, Pyromex®, carbon fibers, and conductive fibers, while keeping, the carbonization, phenomenon characteristics as a cloth are kept, the shrink resistance of the carbonized part and the strength of the carbonized part are maintained; therefore, this is preferable. When these fibers are not contained in the spun yarn, upon exposure to an electric arc, the cloth may be carbonized and thus break up, whereby the cloth shape cannot be retained, and a hole is created in the carbonized cloth portion. It is particularly preferable that the fiber is contained in an amount of 3 to 20% by weight with respect to the weight of the spun yarn.

Here, para-type wholly aromatic polyamide fibers are fibers made of a polyamide having an aromatic ring on the main chain, which are represented by Technora®, Kevlar®, and Twaron®. The polyamide may be poly-p-phenylene terephthalamide (PPTA) or may also be copolyparaphenylene-3,4'-oxydiphenylene terephthalamide (PPODPA), which is a copolymer.

Preferred examples of conductive fibers include fibers containing, as a conductor of the conductive part of the conductive fiber, at least one of carbon black, conductive titanium oxide, conductive whiskers, and carbon nanotubes.

As the form of the conductive fiber, the fiber may be entirely formed of a conductive part, or it is also possible, that a non-conductive part and a conductive part have a sheath-core, sandwiched, or eccentric sectional shape, for example. Resins forming the conductive part and the non-conductive part are not particularly limited as long as they have fiber-forming properties. Specifically, as nylon resins, Nylon 6, Nylon 11, Nylon 12, Nylon 66, and the like can be mentioned. In addition, as polyester resins, polyethylene terephthalate, polytrimethylene terephthalate, polybutylene terephthalate, polyethylene naphthalate, polycyclohexane terephthalate, copolymers thereof, and polyesters having the acid component (terephthalic acid) partially substituted with isophthalic acid, and the like can be mentioned.

Examples of commercially available conductive fibers include "Metalian" (trade name) manufactured by Teijin Limited, "Megana" (trade name) manufactured by Unitika Fibers Ltd., "Luana" (trade name) manufactured by Toray Industries, Inc., and "Clacarbo" (trade name) manufactured by Kuraray Co., Ltd.

The spun yarn described above may be obtained by blending and mix-spinning the above fibers in the usual manner. However, according to the expected functional characteristics, it may also be a sheath-core two-layered spun yarn or a composite yarn using a core-spun yarn or a stretch-broken yarn.

In addition, it may also be a spun yarn in coiled form obtained by the following method.

That is, a spun yarn is prepared first. At this time, in terms of resistance to yarn breakage, strength, and the like, the fineness of the spun yarn (count) is preferably a cotton count (Ecc) of 20 to 60. The number of single yarns is preferably 60 or more, and the raw cotton single-fiber fineness is preferably 3.0 dtex or less (more preferably 0.001 to 3.0 dtex). The twist coefficient (first twist coefficient) of the spun yarn is preferably within a range 3.6 to 4.2 (more preferably 3.8 to 4.0). With an increase in the twist coefficient, the fluff is settled, and the pilling resistance of the cloth is improved; on the other hand, the spun yarn may become rigid, resulting in a decrease in elongation, whereby the tear strength of the cloth decreases or the cloth hardens. Incidentally, the twist coefficient is expressed by the following equation.

$$\text{Twist coefficient} = \text{the number of twists (twists/2.54 cm)} / \text{the cotton count of the spun yarn (Ecc)}^{1/2}$$

The spinning method for the spun yarn may be innovative spinning, such as MTS fine spinning (manufactured by Murata Machinery, Ltd.), MJS fine spinning (manufactured by Murata Machinery, Ltd.), or MVS spinning (manufactured by Murata Machinery, Ltd.), or an ordinary spinning method, such as ring spinning. The twist direction may be Z-direction or S-direction.

Next, the spun yarn is twist-set as necessary (vacuum steam setting), and then two or more of the spun yarns (preferably two to four yarns, particularly preferably two yarns) are aligned, combined, and plied. As examples of twisting machines used for plying, twisting machines such as an up-twister, a covering machine, an Italian twisting machine, and a double twister can be mentioned.

At this time, in plying (second twisting), twisting is performed in the twist-adding direction. For example, in the case where the twist direction of the spun yarn is Z-twisted, twisting is performed in the same direction, that is, in the Z-direction. In addition, the number of twists is preferably 2,000/m or more, more preferably 2,100 to 3,000/m, and particularly preferably 2,300 to 2,800/m. In the case where the number of twists is less than 2,000/m, after twist setting and untwisting, the spun yarn may not be in coiled form.

Next, the plied yarn is twist-set (high-pressure vacuum steam setting as in twist setting for conventional aramid two-ply yarns). In the case where it is necessary to apply strong twist setting, the number of twist setting treatments may be increased, or the twist setting temperature or setting time may be changed. For example, the setting temperature may be 115 to 125° C., the setting time may be 20 to 40, and the number of treatments may be 1 to 3. However, a higher setting temperature or a longer setting time results in better setting properties and thus is more preferable. The setting properties can be further enhanced by increasing the number of twist setting treatments, prolonging the processing time, or raising the temperature. However, considering the production control (the safety of work control, quality control, etc.) or production/processing cost, it is preferable to prolong the processing time. In addition, a higher degree of vacuum results in improved quality and thus is more preferable.

Next, the twist-set plied yarn is untwisted (twisting in the direction opposite to the twist direction in plying), and heat-set as necessary. At this time, it is preferable that the number of twists in untwisting is within a range of 70 to 90% of the number of twists in plying. When untwisting is performed with the number of twists being within this range, a spun yarn in coiled form having stretchability is obtained.

In the spun yarn in coiled form, in order to obtain excellent stretchability, it is preferable that the number of twists is within a range of 200 to 860/m.

In the cloth of the invention, the structure of the cloth is not particularly limited, and may be a woven fabric, a knitted fabric, or a nonwoven fabric. However, in terms of flame retardancy, fire resistance, cloth strength, and the like, a woven fabric is preferable. At this time, as the woven fabric structure, a plain weave structure, a twill weave structure, a satin weave structure, a double fabric, and the like are preferable.

The cloth of the invention can be knitted or woven in the usual manner using the spun yarn described above. It is preferable that knitting or weaving is followed by post-processing. Specific examples of post-processing steps include scouring, drying, relaxation, singeing, dyeing, and functionalization processing.

The scouring or relaxation processing may be open-width processing or liquid-flow scouring/relaxation processing. Specifically, according to such a method, the cloth is processed using an open-width non-tension machine in continuous scouring or continuous drying. The method uses, for example, a Sofcer scouring machine, a tenter and drying machine, a shrink surfer, a short loop, a Luciole dryer, or the like. In addition, in some cases, the scouring or relaxation step may be omitted.

In addition, it is also possible to additionally apply other various function-imparting processes, such as shaving, singeing, a sweat absorbent, a water repellent, a heat storage agent, a UV shielding or antistatic agent, an antibacterial agent, a deodorant, an insect repellent, a mosquito repellent, a mosquito repellent, a phosphorescent agent, and a retroreflective agent. The cloth used may be any of spun-dyed products, yarn-dyed products, and piece-dyed products.

Here, preferred examples of sweat absorbents include polyethylene glycol diacrylate, a polyethylene glycol diacrylate derivative, a polyethylene terephthalate-polyethylene glycol copolymer, and a water-soluble polyurethane.

As methods for applying a sweat absorbent to the cloth, a method including padding processing, a method including processing together with a dyeing liquid in the same bath in the dyeing process, and the like can be mentioned.

In the cloth thus obtained, it is preferable that the cloth has a thickness of 0.25 to 0.50 mm (more preferably 0.32 to 0.45 mm, particularly preferably 0.33 to 0.39 mm). When the thickness of the cloth is less than 0.25 mm, the protection performance against electric arcs may decrease. Conversely, when the thickness of the cloth is more than 0.50 mm, the lightweight properties and wearing comfort may decrease.

In addition, it is preferable that the cloth has a basis weight within a range of 3.0 to 9.0 oz/yd$^2$ (more preferably 5.5 to 9.0 oz/yd$^2$). When the basis weight of the cloth is less than this range, the protection performance against electric arcs may decrease. Conversely, when the basis weight of the cloth is more than this range, the lightweight properties and wearing comfort may decrease.

Because of the above configuration, the cloth of the invention has lightweight properties, wearing comfort, and further protection performance against electric arcs, and is resistant to flash fires.

Here, it is preferable that the cloth has an ATPV value of 8 cal/cm$^2$ or more in Arc Resistance Test ASTM F1959-1999. In addition, it is preferable that the cloth has a limiting oxygen index LOI of 26 or more. Note that the limiting oxygen index LOI is defined as follows. In accordance with the JIS L1096 E method, the concentration of oxygen necessary to keep burning. 50 mm or more is defined as a limiting oxygen index (LOI).

The protective product of the invention is a protective product using the cloth for a protective product described above and selected from the group consisting of protective garments, fireproof garments, work garments, activity garments, gloves, and members for protection. The fireproof garments include firefighting garments. In addition, the activity garments include activity garments for firefighters. In addition, the work garments include work garments for works in a steel plant or steel factory, work garments for welding, and work garments in an explosion-proof area. In addition, the gloves include work gloves used in the aircraft industry, the information equipment industry, the precision machinery industry, and the like where precision components are treated.

The protective product uses the cloth for a protective product described above, and thus is not only lightweight and flame-retardant but also has resistance to flash fires (protection force), and has excellent wearing comfort and safety.

In addition, with respect to the resistance to flash fires (protection force), the more the layers of the cloth are laminated like quilting (quilt stitch), the more the resistance force (protection force) is improved, which is more preferable.

EXAMPLES

Next, examples of the invention and comparative examples will be described in detail, but the invention is not limited thereto.

(1) Lightness Index L-Value

The lightness index L-value was measured using a Macbeth spectrophotometer (Color-Eye 3100).

(2) Absorption Rate of Light at 1,000 to 1,500 nm

Transmittance and reflectance were measured using a spectrophotometer MPC-3100 manufactured by Shimadzu Corporation, and the near-infrared absorption rate at 1,000 to 1,500 nm was calculated.

(3) Thickness

Measurement was performed in accordance with JIS L 1096-1990 6.5.

(4) Arc Resistance

The ATPV value (cal/cm$^2$) was measured in Arc Resistance Test ASTM F1959-1999. Level 2 or higher (ATPV value: 8 cal/cm$^2$ or more) is acceptable.

Example 1

For the warp of a woven fabric, a spun yarn (first-twisted in the Z-direction, the number of twists: 800 to 950 T/m, cotton count: 40/1) made of the following fibers uniformly blended in a blending ratio of 67/10/20/3% by weight in the following order was used: a black polymetaphenylene isophthalamide fiber containing 6% by weight carbon black (absorption rate of light at 1,000 to 1,500 nm: 90% or more) (Teijinconex® manufactured by Teijin Limited, spun-dyed c/#FRNB3, single-fiber fineness: 2.2 dtex, fiber length: 51 mm), flame-retardant rayon (Lenzing Ry manufactured by Lenzing, 1.45 dtex, fiber length: 51 mm, yarn-dyed raw cotton), a polyester fiber (eco-PET (RA02) manufactured by Teijin Limited, single-fiber fineness: 2.2 dtex, fiber length: 38 mm, yarn-dyed raw cotton), a coparaphenylene-3,4'-oxydiphenylene terephthalamide fiber (Technora® T330G manufactured by Teijin Limited, single-fiber fineness: 1.7 dtex, fiber length: 51 mm). The yarns were combined, twisted using a double twister (900 T/m in the S-direction), and then, as twist setting, steam setting was performed at 120° C.×30 min.

In addition, about 2% of the obtained plied yarn for warp was 3-plied including a conductive yarn (B-TCF (U300HX31T5), Teijin Limited), twisted, and set in the same manner as above.

Next, the obtained spun yarn was placed on a creel for warping so as to use the conductive-yarn-containing plied yarn as the warp with a pitch of 2.02 cm wide. The obtained warp beam was subjected to sizing, leasing, and pull-through, thereby preparing the warp.

In addition, as the weft of a woven fabric, a spun yarn (first-twisted in the Z-direction, the number of twists: 800 to 950 T/m, cotton count: 40/1) made of the following fibers uniformly blended in a blending ratio of 67/10/20/3% by weight in the following order was used: a black polymetaphenylene isophthalamide fiber containing 6% by weight carbon black (absorption rate of light at 1,000 to 1,500 nm: 90% or more) (Teijinconex® manufactured by Teijin Limited, spun-dyed c/#FRNB3, single-fiber fineness: 2.2 dtex, fiber length: 51 mm), flame-retardant rayon (Lenzing Ry manufactured by Lenzing, 1.45 dtex, fiber length: 51 mm, yarn-dyed raw cotton), a polyester fiber (eco-PET (RA02) manufactured by Teijin Limited, single-fiber fineness: 2.2 dtex, fiber length: 38 mm, yarn-dyed raw cotton), a coparaphenylene-3,4'-oxydiphenylene terephthalamide fiber (Technora® T330G manufactured by Teijin Limited, single-fiber fineness: 1.7 dtex, fiber length: 51 mm). Yarns were combined, twisted using a double twister (900 T/m in the S-direction), and then, as twist setting, steam setting was performed at 120° C.×30 min.

Next, a 2/2 twill woven fabric (serge woven fabric) was woven at the following weaving design density: a warp density of 87 yarns/2.54 cm and a weft density of 76 yarns/2.54 cm.

The obtained gray fabric was unrolled and sewn in the usual manner, and subjected to desizing, scouring, cylinder drying, singeing, and finishing setting (180° C.×45 to 90 sec) using an open-width non-tension scouring machine (Sofcer), thereby giving a finished textile having a basis weight of 5.8 oz/yd$^2$ and a thickness of 0.37 mm. The evaluation results are shown in Table 1.

manufactured by Teijin Limited) was replaced with a PPTA fiber (Twaron fiber TW 1072 manufactured by Teijin Aramid, single-fiber fineness: 1.7 dtex, fiber length: 51 mm). The evaluation results are shown in Table 1.

Example 3

Processing and evaluation were performed in the same manner as in Example 1, except that the polyester fiber (eco-PET (RA02) manufactured by Teijin Limited, single-fiber fineness: 2.2 dtex, fiber length: 38 mm, yarn-dyed raw cotton) was replaced with a hollow polyester fiber (hollow PET (RA91) manufactured by Teijin Limited, single-fiber fineness: 1.7 dtex, fiber length: 38 mm, yarn-dyed raw cotton, hollow percentage: a little over 10%). The evaluation results are shown in Table 1.

Example 4

According to Example 1, a 1/1 plain woven fabric was woven at the following weaving design density: a warp density of 73 yarns/2.54 cm and a weft density of 57 yarns/2.54 cm. The fabric was processed in the same manner as in Example 1 to give a finished textile having a basis weight of 5.3 oz/yd$^2$ and a thickness of 0.31 mm, and evaluated in the same manner. The evaluation results are shown in Table 1.

Comparative Example 1

Processing and evaluation were performed in the same manner as in Example 4, except that the fiber material and the blending cotton amount were modacrylic 55% by weight and cotton 45% by weight. The evaluation results are shown in Table 1.

Comparative Example 2

Processing and evaluation were performed in the same manner as in Example 4, except that the fiber material and the blending cotton amount were modacrylic 45% by weight, Tencel® 35% by weight, and Twaron® 20% by weight. Evaluation results are shown in Table 1.

TABLE 1

| | Example 1 | Example 2 | Example 3 | Example 4 | Comparative Example 1 | Comparative Example 2 |
|---|---|---|---|---|---|---|
| L-Value | 24.5 | 24.8 | 24.6 | 24.5 | 30.0 | 30.0 |
| Carbon Content (g/m$^2$) | 1.3 | 1.2 | 1.3 | 1.17 | 0.004 | 0.004 |
| ATPV Value (cal/cm$^2$) | 9.8 | 8.9 | 9.2 | 7.7 | 6.9 | 6.7 |
| Arc Resistance | Acceptable | Acceptable | Acceptable | Unacceptable | Unacceptable | Unacceptable |

A protective garment was sewn using the cloth. As a result, the garment had lightweight properties, wearing comfort, and further protection performance against electric arcs, and was resistant to flash fires.

Example 2

Processing and evaluation were performed in the same manner as in Example 1, except that the coparaphenylene-3,4'-oxydiphenylene terephthalamide fiber (Technora®

INDUSTRIAL APPLICABILITY

The invention provides a cloth and a protective product that have lightweight properties, wearing comfort, and further protection performance against electric arcs. The industrial value thereof is extremely high.

The invention claimed is:

1. A cloth, comprising a spun yarn containing (i) a meta-type wholly aromatic polyamide fiber containing carbon black in an amount of 1 to 9% by weight with respect to the weight of the fiber, (ii) a cellulosic fiber, and (iii) a para-type wholly aromatic polyamide fiber, and having a lightness index L-value of 25 or less, and having a thickness of 0.32 to 0.45 mm, and having an ATPV value of 8 cal/cm$^2$ or more in Arc Resistance Test ASTM F1959-1999.

2. The cloth according to claim 1, wherein the spun yarn contains the meta-type wholly aromatic polyamide fiber in an amount of 25% by weight or more with respect to the weight of the spun yarn.

3. The cloth according to claim 1, wherein the spun yarn further contains a molten fiber in an amount of 5 to 20% by weight with respect to the weight of the spun yarn.

4. The cloth according to claim 3, wherein the molten fiber is at least one member selected from the group consisting of vinylon fibers, nylon fibers, and polyester fibers.

5. The cloth according to claim 3, wherein the single-fiber cross-sectional shape of the molten fiber is a round shape, modified shape, or hollow shape.

6. The cloth according to claim 1, wherein the cloth has a woven fabric structure.

7. The cloth according to claim 1, wherein the cloth has a basis weight within a range of 3.0 to 9.0 oz/yd$^2$.

8. The cloth according to claim 1, which has a limiting oxygen index LOI of 26 or more.

9. A protective product comprising the cloth according to claim 1 and selected from the group consisting of protective garments, fireproof garments, work garments, activity garments, gloves, and members for protection.

* * * * *